US010765962B2

(12) United States Patent
King

(10) Patent No.: US 10,765,962 B2
(45) Date of Patent: Sep. 8, 2020

(54) INTERACTIVE MAZE ATTRACTION SYSTEMS AND METHODS

(71) Applicant: Universal City Studios LLC, Universal City, CA (US)

(72) Inventor: Steven Morris King, Orlando, FL (US)

(73) Assignee: UNIVERSAL CITY STUDIOS LLC, Universal City, CA (US)

( * ) Notice: Subject to any disclaimer, the term of this patent is extended or adjusted under 35 U.S.C. 154(b) by 0 days.

(21) Appl. No.: 16/457,084

(22) Filed: Jun. 28, 2019

(65) Prior Publication Data

US 2020/0164283 A1 May 28, 2020

Related U.S. Application Data

(60) Provisional application No. 62/772,499, filed on Nov. 28, 2018.

(51) Int. Cl.

| | |
|---|---|
| ***A63J 11/00*** | (2006.01) |
| ***A63F 9/02*** | (2006.01) |
| ***A63G 21/04*** | (2006.01) |
| *A63F 9/00* | (2006.01) |

(52) U.S. Cl.

CPC ..... *A63J 11/00* (2013.01); *A63F 9/0204* (2013.01); *A63F 9/0291* (2013.01); *A63G 21/04* (2013.01)

(58) Field of Classification Search

CPC .. A63J 11/00; E04B 1/00; E04B 1/346; A63B 9/00

USPC ..... 472/2, 62, 136; 273/153 R; 52/64–65

See application file for complete search history.

(56) References Cited

U.S. PATENT DOCUMENTS

| | | | | |
|---|---|---|---|---|
| 4,154,440 | A | 5/1979 | Rusk | |
| 5,127,657 | A | 7/1992 | Ikezawa et al. | |
| 5,364,311 | A | 11/1994 | Chou | |
| 5,393,074 | A | 2/1995 | Bear et al. | |
| 5,474,501 | A | 12/1995 | Teng | |
| 6,095,927 | A | 8/2000 | Malone | |
| 6,099,411 | A * | 8/2000 | Van Wagenen | A63B 9/00 472/136 |
| 6,675,538 | B2 | 1/2004 | Candio | |
| 6,855,062 | B1 * | 2/2005 | Truong | A63J 11/00 472/134 |
| 8,520,004 | B2 | 8/2013 | Pedersen | |
| 9,697,742 | B2 | 7/2017 | Faver et al. | |

(Continued)

FOREIGN PATENT DOCUMENTS

| | | | |
|---|---|---|---|
| CN | 205323232 | U | 6/2016 |
| CN | 106209950 | A | 12/2016 |

(Continued)

OTHER PUBLICATIONS

PCT/US2019/062007 Invitation to Pay Additional Fees Jan. 21, 2020.

*Primary Examiner* — Kien T Nguyen

(74) *Attorney, Agent, or Firm* — Fletcher Yoder, P.C.

(57) ABSTRACT

An attraction system includes a first level, a second level positioned vertically above or below the first level, and one or more controllers configured to present a game environment to one or more riders in a ride vehicle as the ride vehicle travels along a path on the first level. The attraction system also includes a lift configured to move the ride vehicle vertically from the first level to the second level based at least in part on a performance of the one or more riders in the game environment.

20 Claims, 3 Drawing Sheets

(56) References Cited

U.S. PATENT DOCUMENTS

| | | | |
|---|---|---|---|
| 2003/0106455 | A1 | 6/2003 | Weston |
| 2011/0079665 | A1 | 4/2011 | Lunde et al. |
| 2015/0190726 | A1 | 7/2015 | Frolov |
| 2016/0089610 | A1 | 3/2016 | Boyle et al. |
| 2018/0056209 | A1 | 3/2018 | Jensen et al. |

FOREIGN PATENT DOCUMENTS

| | | | |
|---|---|---|---|
| FR | 2771651 | A | 6/1999 |
| JP | H08117451 | A | 5/1996 |
| JP | 2000300859 | A | 10/2000 |
| JP | 2000350873 | A | 12/2000 |

* cited by examiner

INTERACTIVE MAZE ATTRACTION SYSTEMS AND METHODS

CROSS-REFERENCE TO RELATED APPLICATION

This application claims priority to and the benefit of U.S. Provisional Application No. 62/772,499, entitled "INTERACTIVE MAZE ATTRACTION SYSTEMS AND METHODS," filed Nov. 28, 2018, which is hereby incorporated by reference in its entirety for all purposes.

BACKGROUND

The present disclosure relates generally to the field of amusement parks. More specifically, embodiments of the present disclosure relate to interactive maze attraction systems and methods.

Amusement parks and/or theme parks may include various entertainment attractions. One type of entertainment attraction may include a ride attraction with a ride vehicle that moves along a fixed path. However, with the increasing sophistication of modern entertainment attractions and the corresponding increase in expectations among guests, improved and more creative entertainment attractions are needed. For example, it is now recognized that it would desirable to provide a ride attraction that provides a variable and/or an interactive experience.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, an attraction system includes a first level, a second level positioned vertically above or below the first level, and one or more controllers configured to present a game environment to one or more riders in a ride vehicle as the ride vehicle travels along a path on the first level. The maze attraction system also includes a lift configured to move the ride vehicle vertically from the first level to the second level based at least in part on a performance of the one or more riders in the game environment.

In an embodiment, a maze attraction system includes a maze defined by multiple walls and one or more controllers configured to present a game environment to one or more riders in a ride vehicle as the ride vehicle travels through the maze. The multiple walls include a first movable wall positioned along a first path through the maze and a second movable wall positioned along a second path through the maze, the first movable wall and the second movable wall are each configured to move between a respective first position to block passage of the ride vehicle and a respective second position to enable passage of the ride vehicle. The one or more controllers are configured to select and to move one of the first movable wall or the second movable wall from the respective first position to the respective second position to enable passage of the ride vehicle along the first path or the second path, respectively, based at least in part on a performance of the one or more riders in the game environment.

In an embodiment, a method includes driving, using one or more controllers, a ride vehicle through a maze. The method also includes presenting, using the one or more controllers, a game environment to one or more riders in the ride vehicle as the ride vehicle travels along a path through the maze. The method further includes monitoring, via the one or more controllers, a performance of the one or more riders in the game environment. The method further includes operating, via the one or more controllers, a lift to move the ride vehicle vertically from a first level to a second level located vertically above or below the first level based at least in part on the performance of the one or more riders in the game environment.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

The present disclosure is directed to an attraction system for an amusement park or a theme park. The attraction system may include various features that provide a variable experience to riders. Such features may include multiple different paths through a maze of the attraction system, movable walls, multiple levels (e.g., vertically-spaced levels), and/or lifts that move (e.g., raise and/or lower) ride vehicles between the multiple levels. In an embodiment, the attraction system may provide a game environment and/or include features that facilitate interaction between riders and the attraction system. For example, user input (e.g., direct input or indirect input via game performance in the game environment) may select a path through the attraction system, cause movement of the movable walls, cause the lift to move the ride vehicle between the multiple levels, and/or adjust ride effects (e.g., animatronic characters, visual effects, audio effects). In this manner, repeat riders may have a different experience during each ride.

While the present techniques are disclosed in conjunction with a maze attraction system in which riders are positioned within ride vehicles to travel through the maze attraction system, other embodiments may involve other attraction types. For example, a maze attraction in which guests walk through a maze having movable walls, multiple levels, and/or lifts as provided herein is also envisioned. Furthermore, the maze attraction system (or at least some levels of the maze attraction system) disclosed herein may be devoid of a maze structure, and instead may include one path and/or generally open spaces through which the ride vehicle may move or drive.

Figure 1:
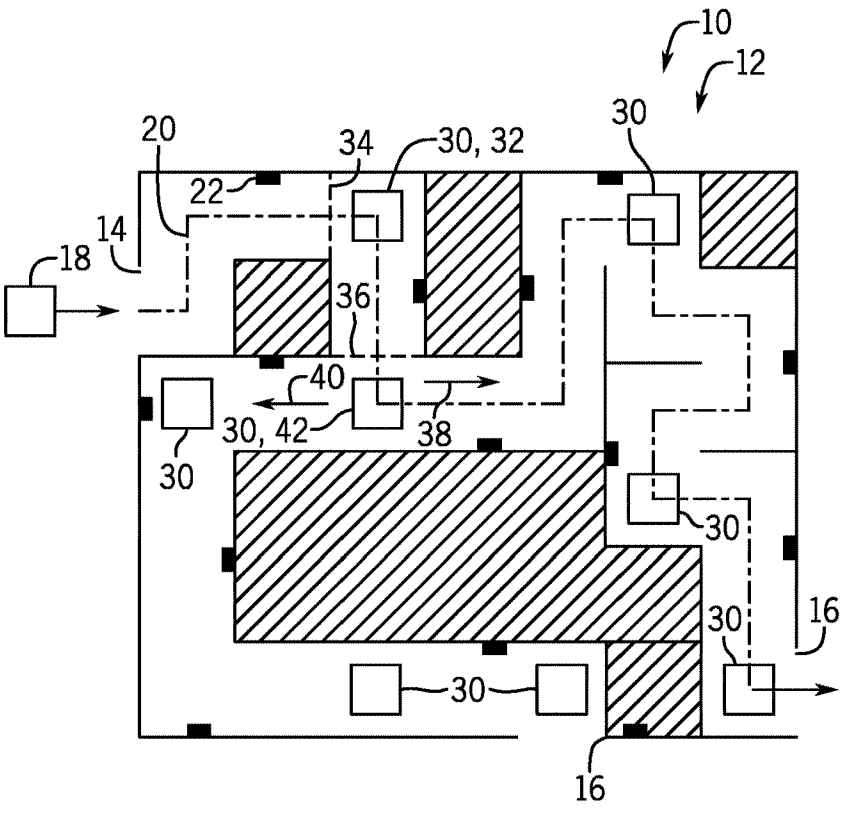
FIG. 1 is a schematic top view of a maze attraction system having one or more lifts within a maze, in accordance with an embodiment of the present disclosure.

FIG. 1 is a schematic view of an embodiment of a portion of a maze attraction system 10. In the illustrated embodiment, the maze attraction system 10 includes a maze 12 having one entrance 14 and multiple exits 16. In operation, a ride vehicle 18 carrying one or more riders may enter the maze 12 via the entrance 14 and may follow a path, such as a path 20, to one of the exits 16. It should be appreciated that the maze 12 may have any suitable number of entrances 14 (e.g., 1, 2, 3, 4, or more) and/or exits 16 (e.g., 1, 2, 3, 4, or more), as well as any suitable number of paths (e.g., 1, 2, 3, 4, or more).

In an embodiment, the ride vehicle 18 is an automated vehicle (e.g., autonomous, self-driven, automated guided vehicle [AGV]) that is powered by a motor (e.g., linear synchronous motor [LSM]) and that navigates through the maze 12 without direct control by the rider (e.g., without a steering wheel or pedals operated by the rider). For example and as discussed in more detail below, the ride vehicle 18 may include a ride vehicle controller (e.g., electronic controller) that is programmed to follow a path based on one or more paths stored in its memory device, based on inputs from wires in a floor of the maze 12, and/or based on instructions received from an attraction controller (e.g., electronic controller).

In an embodiment, the maze attraction system 10 may provide a game experience in which the one or more riders in the ride vehicle 18 collect points, complete gaming battles, solve puzzles, or participate in various other gaming activities. Thus, as the ride vehicle 18 travels through the maze 12, the one or more riders may interact with a game environment of the maze attraction system 10. For example, the game environment may include targets 22 (e.g., physical targets or virtual targets, such as virtual targets projected onto a wall that defines the maze 12) throughout the maze 12, and the one or more riders may operate an input device on the ride vehicle 18 to virtually or actually hit the targets 22 (e.g., launching shells, aiming a light beam) to collect points. The one or more riders may additionally or alternatively complete challenges (e.g., gaming battles and/or puzzles), such as by hitting targets 22 as part of a gaming battle or by answering questions by hitting targets 22 that correspond to particular answers. The attraction controller, or other suitable processing device, may monitor the game performance of the one or more riders as the ride vehicle 18 travels through the maze 12.

In an embodiment, the maze attraction system 10 may include multiple levels (e.g., 2, 3, 4, or more vertically-spaced levels). As shown, one or more lifts 30 may be provided to move (e.g., raise and/or lower) the ride vehicle 18 between the multiple levels, and the one or more lifts 30 may move the ride vehicle 18 based on the game performance. Some or all of the lifts 30 may be used to raise the ride vehicle 18 and/or some or all of the lifts 30 may be used to lower the ride vehicle 18. For example, a first lift 30, 32 may only be used to lower the ride vehicle 18. In such cases, if a score for the one or more riders is below a lift threshold when the ride vehicle 18 reaches the first lift 30, 32 (e.g., as measured at a first checkpoint 34, which may be at any location proximate to the first lift 30, 32), the ride vehicle 18 may be positioned on the first lift 30, 32, and the ride vehicle 18 may be lowered to a lower level (e.g., vertically below the level with the maze 12) via the first lift 30, 32. However, if the score for the one or more riders is above the lift threshold when the ride vehicle 18 reaches the first lift 30, 32, the ride vehicle 18 may continue along the path 20. Some or all of the other lifts 30 may operate in a similar manner, and thus, the ride vehicle 18 may drop to the lower level and may be removed from the maze 12 at various locations in the maze 12 if the score is below a respective lift threshold at each of the lifts 30 (e.g., due to poor game performance).

In an embodiment, the first lift 30, 32 may only be used to raise the ride vehicle 18. In such cases, if a score for the one or more riders is above a lift threshold when the ride vehicle 18 reaches the first lift 30, 32 (e.g., as measured at the first checkpoint 34), the ride vehicle 18 may be positioned on the first lift 30, 32, and the ride vehicle 18 may be raised to an upper level (e.g., vertically above the level with the maze 12) via the first lift 30, 32. However, if the score for the one or more riders is below the lift threshold when the ride vehicle 18 reaches the first lift 30, 32, the ride vehicle 18 may continue along the path 20. Some or all of the other lifts 30 may operate in a similar manner, and thus, the ride vehicle 18 may rise to the upper level and may be removed from the maze 12 at various locations in the maze 12 if the score is above a respective lift threshold at each of the lifts 30 (e.g., due to excellent game performance).

In an embodiment, the first lift 30, 32 may be used to either raise or lower the ride vehicle 18 based on the game performance. In such cases, if a score for the one or more riders is above a first lift threshold when the ride vehicle 18 reaches the first lift 30, 32 (e.g., as measured at the first checkpoint 34), the ride vehicle 18 may be raised to the upper level via the first lift 30, 32. However, if the score for the one or more riders is below a second lift threshold when the ride vehicle 18 reaches the first lift 30, 32, the ride vehicle 18 may be lowered to the lower level via the first lift 30, 32. If the score for the one or more riders is in a range between the first and second lift thresholds, the ride vehicle 18 may continue along the path 20. Some or all of the other lifts 30 may operate in a similar manner, and thus, the ride vehicle 18 may rise to the upper level or drop to the lower level at various locations in the maze 12 (e.g., due to excellent game performance or poor game performance, respectively). It should be appreciated that in an embodiment, game performance above a lift threshold may result in lowering the ride vehicle 18 to the lower level, while game performance below a lift threshold may result in raising the ride vehicle 18 to the upper level.

It should be appreciated that the game performance of the one or more riders may refer to any game performance, including the score (e.g., overall cumulative number of points, which may be based on a number of targets 22 hit) and/or the outcome of one or more challenges (e.g., gaming battles and/or puzzles). Thus, the outcome of a challenge proximate to the first lift 30, 32 (e.g., at the first checkpoint 34) may affect whether the ride vehicle 18 is moved up or down via the first lift 30, 32. For example, if the one or more riders fails in the challenge, the ride vehicle 18 may be lowered to the lower level via the first lift 30, 32. However, if the one or more riders succeeds in the challenge, the ride vehicle 18 may continue along the path 20.

In an embodiment, the ride vehicle 18 may be directed along a fixed path (e.g., predetermined path) through the maze 12. For example, the ride vehicle 18 may be programmed (e.g., via instructions stored in a memory device of the ride vehicle controller) or otherwise directed (e.g., via the attraction controller and/or via selection by the one or more riders prior to the ride) to follow the path 20 through the maze 12, and the path 20 taken by the ride vehicle 18 through the maze 12 may not vary based on the game performance. Instead, the ride vehicle 18 may travel along the path 20 and may be moved out of the path 20 (e.g., raised and/or lowered) via the one or more lifts 30 based on the game performance. The ride vehicle 18 may be directed along different fixed paths in subsequent trips through the maze 12, and/or other ride vehicles 18 may be directed along different fixed paths through the maze 12. In this way, the one or more riders may experience variation in the ride experience by traveling along different paths during repeat rides, and also by moving out of the maze 12 via the one or more lifts 30 at different points in the maze 12 based on the game performance during repeat rides.

Alternatively, the path taken by the ride vehicle 18 through the maze 12 may vary based on the game performance. For example, the attraction controller may direct the ride vehicle 18 (e.g., via instructions to the ride vehicle controller and/or via signals in wires in the floor of the maze) to move along one of many paths based on the game performance. For example, if a score is above a path threshold (e.g., as measured at a second checkpoint 36), the ride vehicle 18 may be directed in a first direction 38 along the path 20. However, if the score is below the path threshold at the second checkpoint 36, the ride vehicle 18 may be directed in a second direction 40 along a different path. In this way, the one or more riders may affect (e.g., indirectly via game performance) which path the ride vehicle 18 takes through the maze 12, and the one or more riders may experience different paths during repeat rides. Additional paths (e.g., 1, 2, 3, 4, or more) may diverge from a point (e.g., at the second checkpoint 36), and thus, multiple different path thresholds may be utilized.

As noted above, the game performance may refer to any game performance, including a score and/or an outcome of one or more challenges. For example, the one or more riders may be presented with a challenge within the maze 12 (e.g., at the second checkpoint 36), and the outcome of the challenge may affect which path the ride vehicle 18 takes through the maze 12. For example, if the one or more riders succeeds in the challenge, the ride vehicle 18 may be directed in the first direction 38 along the path 20. However, if the one or more riders fails in the challenge, the ride vehicle 18 may be directed in the second direction 40 along the different path.

Optionally, one of the one or more lifts 30 (e.g., a second lift 30, 42) may be located at the point where multiple paths diverge (e.g., where the path 20 diverges from the different path). For example, in the illustrated embodiment, after reaching the second checkpoint 36, the ride vehicle 18 may be directed in the first direction 38 along the path 20, directed in the second direction 40 along the different path, lowered to the lower level, and/or raised to the upper level (e.g., based on the game performance, such as by comparing a score to respective thresholds and/or based on an outcome of a challenge). For example, a first score (e.g., highest score) may result in the ride vehicle 18 being raised to the upper level, a second score (e.g., a next highest score) may result in the ride vehicle 18 being directed in the first direction 38 along the path 20, a third score (e.g., a next highest score) may result in the ride vehicle 18 being directed in the second direction 40 along the different path, and/or a fourth score (e.g., a lowest score) may result in the ride vehicle 18 being lowered to the lower level.

Furthermore, it should be appreciated that the maze attraction system 10 may utilize any of a variety of more complex gaming rules to control the path of the ride vehicle 18 through the maze attraction system 10. For example, if a score for the one or more riders is below a lift threshold when the ride vehicle 18 reaches the first lift 30, 32, the ride vehicle 18 may be lowered to the lower level via the first lift 30, 32. However, if the score for the one or more riders is above the lift threshold such that the ride vehicle 18 will not be lowered to the lower level by the first lift 30, 32, then the one or more riders may be presented with a challenge. The outcome of the challenge may be utilized to determine whether the ride vehicle 18 will be directed in the first direction 38 along the path 20 or in the second direction 40 along the different path. For example, if the one or more riders succeeds in the challenge, the ride vehicle 18 may be directed in the first direction 38 along the path 20. However, if the one or more riders fails in the challenge, the ride vehicle 18 may be directed in the second direction 40 along the different path.

It should be appreciated that each level (e.g., a lowest level, an uppermost level, and/or any intermediate levels) of the maze attraction system 10 may include a different maze, and the ride vehicle 18 may be raised and/or lowered multiple times to move through multiple different mazes as the ride vehicle 18 travels through the maze attraction system 10. Additionally, the ride vehicle 18 may move one or more levels at a time. Each level may have a different game difficulty. For example, the lower level(s) may provide generally easier games (e.g., larger targets, easier puzzles), and the upper level(s) may provide generally harder games (e.g., smaller targets, more difficult puzzles). In an embodiment, at least one level (e.g., the lowest level) may not include a maze and/or ride effects. For example, the game may end when the ride vehicle 18 is lowered to the lowest level, and the ride vehicle 18 may be directed straight to an exit of the lowest level where the rider exits the ride vehicle 18. With the disclosed embodiments, the rider may feel rewarded for excellent game performance by physically moving up to a higher level, where the rider may experience new and/or more challenging game elements. Additionally or alternatively, the rider is driven to excel in the game to avoid dropping to the lower level, which may end the game. As shown, one or more lifts 30 may be provided adjacent to the exits 16, and the ride vehicle 18 may be moved to another level (e.g., lowest level) to exit. In an embodiment, the maze attraction system 10 may include tracks (e.g., rollercoaster tracks) extending from each level to an exit level (e.g., ground level) and/or the lifts 30 that may carry the ride vehicle 18 to the exit level, and moving up to the upper level(s) during the game may result in a more thrilling drop via the tracks or the lifts 30 at the end of the game.

Figure 2:
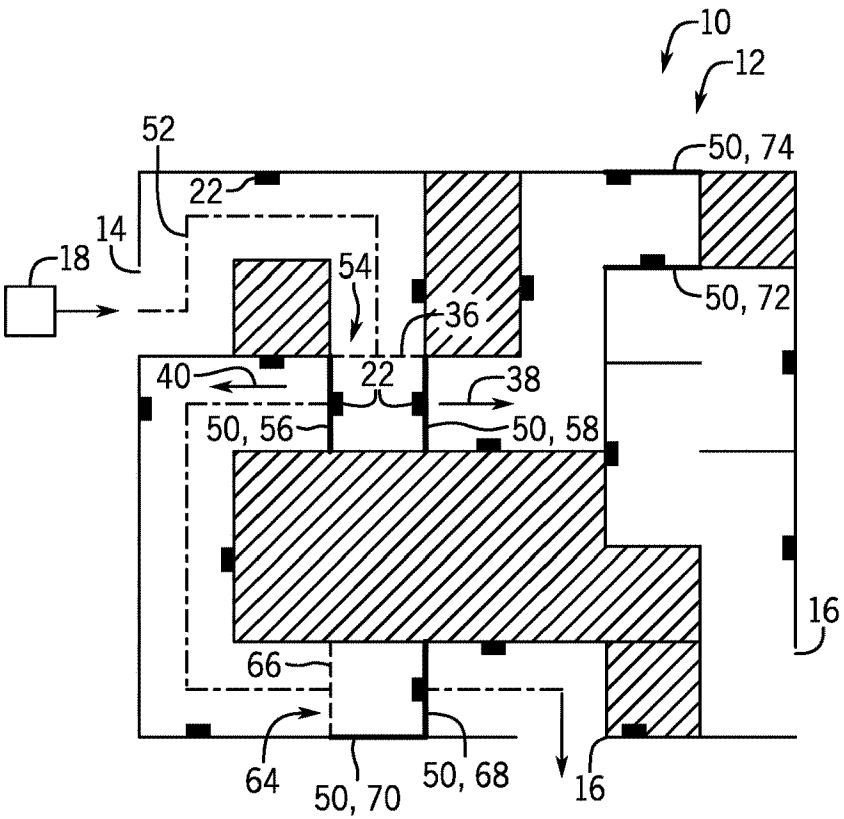
FIG. 2 is a schematic top view of a maze attraction system having a maze defined by one or more movable walls, in accordance with an embodiment of the present disclosure.

FIG. 2 is an embodiment of the maze attraction system 10 having the maze 12 at least partially defined by one or more movable walls 50. In operation, the ride vehicle 18 carrying one or more riders may enter the maze 12 via the entrance 14 and may follow any of a variety of paths, such as a path 52, to one of the exits 16. As noted above, the ride vehicle 18 may be an automated vehicle that navigates through the maze 12 without direct control by the rider; however, the rider may affect which path the ride vehicle 18 takes through the maze 12 (e.g., via game performance).

The one or more riders may interact with an environment of the maze attraction system 10 (e.g., as part of a game). For example, as the ride vehicle 18 approaches a portion 54 (e.g., enclosed portion or dead-end) of the maze 12, the one or more riders may select (e.g., using the input device of the ride vehicle 18) a first movable wall 50, 56 or a second movable wall 50, 58 to select the path forward. The one or more riders may select one of the movable walls 50 in any of a variety of manners, such as directly by hitting one or more targets 22 on one of the movable walls 50 using the input device of the ride vehicle 18 (e.g., which may give the effect of launching or breaking down the wall) or indirectly based on game performance prior to reaching the portion 54 of the maze 12 (e.g., at the second checkpoint 36). For example, if a score for the rider is above a wall threshold prior to reaching the portion 54, the first movable wall 50, 56 may move to enable the ride vehicle 18 to move in the second direction 40 along the path 52. However, if the score for the rider is below the wall threshold prior to reaching the portion 54, the second movable wall 50, 58 may move to enable the ride vehicle 18 to move in the first direction 38 along a different path (e.g., the path 20 of FIG. 1). Additional movable walls 50 (e.g., 1, 2, 3, 4, or more) may be positioned to block and enable passage to additional paths (e.g., 1, 2, 3, 4, or more) that diverge from the portion 54 of the maze 12, and thus, multiple different wall thresholds may be utilized.

As noted above, the game performance may refer to any game performance, including a score and/or an outcome of one or more challenges. For example, the one or more riders may be presented with a challenge proximate to the portion 54 of the maze 12 (e.g., upstream of the portion 54 or while at a stop within the portion 54). In an embodiment, if the one or more riders succeeds in the challenge, the first movable wall 50, 56 may move to enable the ride vehicle 18 to move in the second direction 40 along the path 52. However, if the rider fails in the challenge, the second movable wall 50, 58 may move to enable the ride vehicle 18 to move in the first direction 38. In this way, the movable walls 50 may enable direct path selection by the one or more riders (e.g., by hitting targets 22 on one of the movable walls 50) and/or may enable indirect path selection by the one or more riders as the open path through the maze 12 changes based on game performance.

Some or all of the movable walls 50 may also be used as potential end points in the game. For example, if the score for the one or more riders is above a wall threshold prior to reaching another portion 64 (e.g., enclosed portion or dead-end) of the maze 12 (e.g., at a third checkpoint 66), a third movable wall 50, 68 may move to enable the ride vehicle 18 to continue to move along the path 52. However, if the score for the rider is below the wall threshold prior to reaching the portion 64, a fourth movable wall 50, 70 may move to reveal another exit and the ride vehicle 18 may be directed out of the maze 12. It should be appreciated that the one or more riders may be presented with a challenge proximate to the portion 64 of the maze 12 (e.g., upstream of the portion 64 or while at a stop within the portion 64), and the movement of the third movable wall 50, 68 and/or the fourth movable wall 50, 70 may depend on the outcome of the challenge, as discussed above. For example, if the one or more riders succeeds in the challenge, the third movable wall 50, 68 may move to enable the ride vehicle 18 to continue along the path 52. However, if the rider fails in the challenge, the fourth movable wall 50, 70 may move to reveal another exit and the ride vehicle 18 may be directed out of the maze 12. Additional movable walls 50 may be provided at various other locations at which paths diverge and/or at various other potential end points within the maze 12 (e.g., a fifth movable wall 50, 72 and a sixth movable wall 50, 74). Thus, the ride vehicle 18 may move out of the maze 12 at different locations (e.g., based on the game performance), and the maze attraction system 10 may provide multiple different experiences for the one or more riders during repeat rides.

Figure 3:
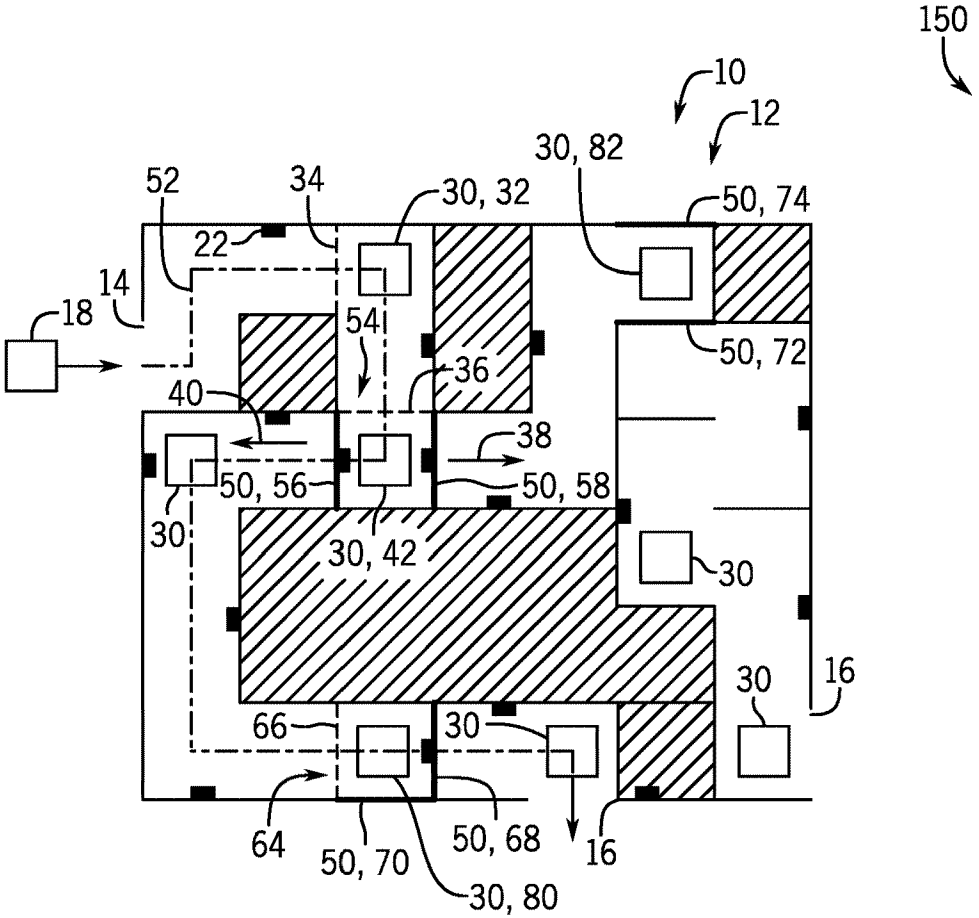
FIG. 3 is a schematic top view of a maze attraction system having one or more lifts within a maze defined by one or more movable walls, in accordance with an embodiment of the present disclosure.

FIG. 3 is an embodiment of the maze attraction system 10 having the one or more lifts 30 shown in FIG. 1 and the one or more movable walls 50 shown in FIG. 2. The one or more lifts 30 may be used in combination with the one or move movable walls 50 to provide a variety of experiences in the maze attraction system 10. In operation, the ride vehicle 18 carrying one or more riders may enter the maze 12 via the entrance 14 and may follow any of a variety of paths, such as the path 52, to one of the exits 16. As noted above, the ride vehicle 18 may be an automated vehicle that navigates through the maze 12 without direct control by the one or more riders; however, the one or more riders may affect which path the ride vehicle 18 takes through the maze 12 (e.g., via game performance).

Operation of the one or more lifts 30 and/or movement of the movable walls 50 may be based on the game performance. The first lift 30, 32 may operate in the manner discussed above with respect to FIG. 1. For example, the first lift 30, 32 may move the ride vehicle 18 out of the maze 12 based on the game performance (e.g., as measured at the first checkpoint 34). In the illustrated embodiment, the second lift 30, 42 is positioned proximate to movable walls 50, such as at a point where multiple paths blocked by the first movable wall 50, 56 and the second movable wall 50, 58 diverge from one another. Thus, after reaching the second checkpoint 36, the ride vehicle 18 may be directed in the first direction 38, directed in the second direction 40, lowered to the lower level, and/or raised to the upper level (e.g., based on the game performance, such as by comparing a score to respective thresholds and/or based on an outcome of a challenge). For example, a first score (e.g., highest score) may result in the ride vehicle 18 being raised to the upper level, a second score (e.g., a next highest score) may result in movement of the second movable wall 50, 58 to enable the ride vehicle 18 to travel in the first direction 38, a third score (e.g., a next highest score) may result in movement of the first movable wall 50, 56 to enable the ride vehicle 18 to travel in the second direction 40, and/or a fourth score (e.g., a lowest score) may result in the ride vehicle 18 being lowered to the lower level.

As noted above, the maze attraction system 10 may utilize any of a variety of more complex gaming rules to control the path of the ride vehicle 18 through the maze attraction system 10. For example, if a score for the one or more riders is below a lift threshold when the ride vehicle 18 reaches the second lift 30, 42, the ride vehicle 18 may be lowered to the lower level via the second lift 30, 42. However, if the score for the one or more riders is above the lift threshold such that the ride vehicle 18 will not be lowered to the lower level by the second lift 30, 42, then the one or more riders may be given the opportunity to select the path forward (e.g., by hitting targets 22 on either the first movable wall 50, 56 or the second movable wall 50, 58) or the one or more riders may be presented with a challenge. In such cases, the outcome of the challenge may be utilized to trigger movement of either the first movable wall 50, 56 or the second movable wall 50, 58. For example, if the one or more riders succeeds in the challenge, the first movable wall 50, 56 may move to enable the ride vehicle 18 to travel in the second direction 40. However, if the one or more riders fails in the challenge, the second movable wall 50, 58 may move to enable the ride vehicle 18 to travel in the first direction 38.

As shown, one or more lifts 30 and one or more movable walls 50 may be positioned at various other locations in the maze 12, including at other potential end points in a level of the game or in the game. In an embodiment, one of the one or more lifts 30 (e.g., a third lift 30, 80) may be utilized in lieu of the fourth movable wall 50, 70 to provide an exit from the maze 12. In some such cases, if the score for the one or more riders is below a lift threshold prior to the portion 64 (e.g., at the third checkpoint 66), the ride vehicle 18 may be lowered to the lower level via the third lift 30, 80. However, if the score for the one or more riders is above the lift threshold, the third movable wall 50, 68 may move to enable the ride vehicle 18 to continue to travel along the path 52.

However, as shown, the third lift 30, 80 may be provided in addition to the fourth movable wall 50, 70 to provide additional possible paths once the ride vehicle 18 reaches the portion 64 of the maze 12. For example, in the illustrated embodiment, after reaching the portion 64 of the maze, the third movable wall 50, 68 may move to enable the ride vehicle 18 to continue to travel along the path 52, the fourth movable wall 50, 70 may move to enable the ride vehicle 18 to exit the maze 12, the ride vehicle 18 may be lowered to the lower level via the third lift 30, 80, and/or the ride vehicle 18 may be raised to the upper level via the third lift 30, 80 (e.g., based on the game performance, such as by comparing a score to respective thresholds and/or based on an outcome of a challenge). Any of a variety of more complex gaming rules (e.g., combinations of points and challenges) may be utilized to control the path of the ride vehicle 18 at the portion 64 of the maze 12. Similarly, one of the one or more lifts 30 (e.g., a fourth lift 30, 82) may be utilized in lieu of or in addition to the sixth movable wall 50, 74.

It should be appreciated that the mazes 12 illustrated herein are merely exemplary and that the maze(s) utilized in the maze attraction system 10 may have any of a variety of configurations, including additional movable walls 50 and/or lifts 30. It should also be appreciated that the one or more riders may provide a driving user input via a driving input device (e.g., steering wheel, button, touchscreen) on the ride vehicle 18 to guide at least some movements of the ride vehicle 18 within the maze 12.

Figure 4:
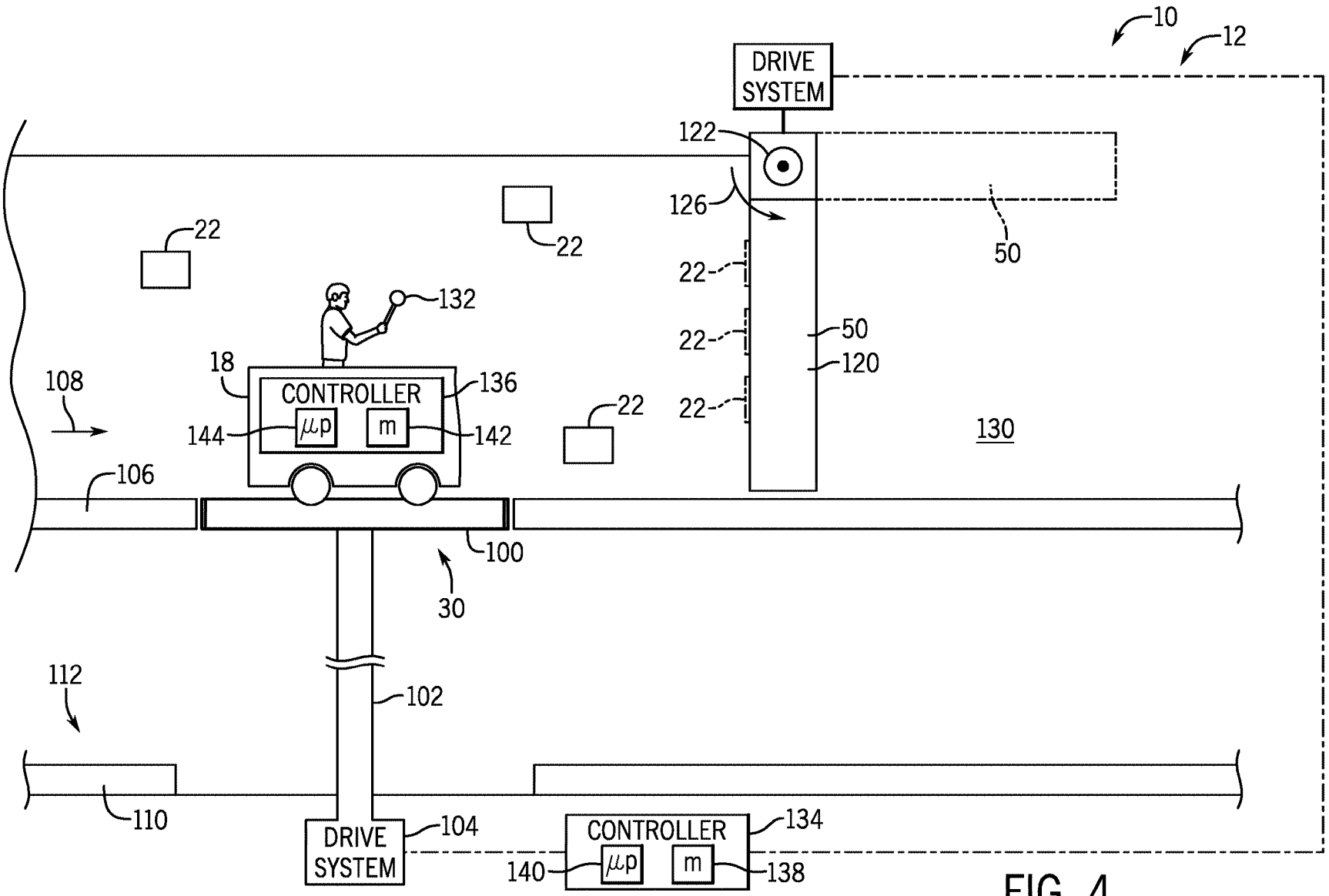
FIG. 4 is a side view of a portion of the maze attraction system of FIG. 3, in accordance with an embodiment of the present disclosure.

FIG. 4 is a side view of the maze attraction system 10, in accordance with an embodiment of the present disclosure. As shown, the maze attraction system 10 may include one or more lifts 30 and one or more movable walls 50. The illustrated lift 30 is a lift system that includes a platform 100, an adjustable arm 102, and a drive system 104. In operation, the platform 100 may support the ride vehicle 18 as the drive system 104 adjusts the adjustable arm 102 between the illustrated extended position (e.g., raised position) and a retracted position (e.g., lowered position). In the extended position, the platform 100 may be aligned (e.g., along a vertical axis) and flush with a first floor 106 of an upper level 108. In the retracted position, the platform 100 may be aligned (e.g., along the vertical axis) and flush with a second floor 110 of a lower level 112. The lift 30 may be electrically, hydraulically, or pneumatically driven (e.g., open a vent valve to move to the retracted position, then close the vent valve and re-pressurize to move to the extended position). In an embodiment, it may be desirable for some or all of the lifts 30 in the maze attraction system 10 to only lower the ride vehicle 18, as raising the ride vehicle 18 may utilize larger and more expensive lift equipment (e.g., compared to lift equipment that only provides a controlled fall for the ride vehicle 18).

As illustrated, the movable wall 50 is a movable wall system that includes a wall panel 120, a shaft 122, and a drive system 124. Although the wall panel 120 is shown as a flat wall panel, it should be appreciated that the wall panel 120 may have any of a variety of configurations (e.g., wavy, angled). In operation, the drive system 124 may drive the shaft 122 and the wall panel 120 (e.g., non-rotatably coupled to the shaft 122) to rotate (e.g., as shown by arrow 126) between the illustrated first position in which the wall panel 120 blocks travel of the ride vehicle 18 to a portion 130 of the upper level 108 and a second position in which the wall panel 120 enables travel of the ride vehicle 18 to the portion 130 of the upper level 108. The movable wall 50 may be electrically, hydraulically, or pneumatically driven (e.g., a drive shaft of an electric motor may drive rotation of the shaft 122). While the shaft 122 is shown extending along a horizontal axis proximate to an upper edge of the wall panel 120, it should be appreciated the shaft 122 may extend along the horizontal axis proximate to a lower edge of the wall panel 120 (e.g., to rotate the wall panel 120 to lay against or flush with the first floor 106 of the upper level 108), or the shaft 122 may extend along a vertical axis proximate to either side of the wall panel 120 to rotate the wall panel 120. Furthermore, various other mechanisms for moving the wall panel 120 are envisioned, such as a rolling system that rolls the wall panel 120 or a sliding system that slides the wall panel 120.

During the ride, the one or more riders may be positioned in the ride vehicle 18. The one or more riders may use an input device 132 to interact with the game environment to play a game as the ride vehicle 18 travels through the maze attraction system 10. For example, the one or more riders may launch shells from the input device 132 or aim a laser beam emitted by the input device 132 toward one or more targets 22, which may be physical targets mounted to one or more walls of the maze 12 or virtual targets displayed on or projected onto one or more walls of the maze 12. In an embodiment, at least some of the one or more targets 22 may be on the wall panel 120 of the movable wall 50.

An attraction controller 134 (e.g., electronic controller) may receive (e.g., via a wireless or wired connection) signals indicative of the interactions with the game environment (e.g., from the one or more targets 22, from the input device 132, and/or from a ride vehicle controller 136 [e.g., electronic controller]), and the attraction controller 134 may calculate a score for the one or more riders based on the signals. The attraction controller 134 may also compare the score to the respective thresholds discussed herein. Alternatively, the calculation and comparison may be performed by the ride vehicle controller 136 or other suitable processing device.

In an embodiment, the attraction controller 134 may generate control signals to instruct presentation of the one or more targets 22 throughout the maze 12. The attraction controller 134 may also instruct presentation of one or more challenges to the one or more riders, such as a gaming battle displayed on or projected onto the wall panel 120 of the movable wall 50 (e.g., an integrated display of the wall panel 120), and the attraction controller 134 may determine an outcome of the one or more challenges as discussed herein. The attraction controller 134 may further instruct movement of the lift 30 and the movable wall 50 based on the game performance (e.g., the score and/or the outcome of the one or more challenges).

More particularly, the attraction controller 134 may include a memory device 138 and a processor 140 that enable the attraction controller 134 to control (e.g., via control signals) the drive system 104 of the lift 30, the drive system 124 of the movable wall 50, game elements (e.g., the targets 22 and any other displayed or projected content), and/or ride effects (e.g., animatronic characters, visual effects, audio effects). In an embodiment, the attraction controller 134 may also provide control signals to the ride vehicle controller 136 to control the movement of the ride vehicle 18 through the maze attraction system 10. The ride vehicle controller 136 may include a memory device 142 and a processor 144.

The attraction controller 134 and the ride vehicle controller 136 are part of a control system that coordinates movement of the various elements in the maze attraction system 10. Furthermore, the various functions described herein may be divided between the attraction controller 134, the ride vehicle controller 136, and/or one or more other processing devices in any suitable manner. Additionally, the memory devices 138, 142 may include one or more tangible, non-transitory, computer-readable media that store instructions executable by the processors 140, 144 and/or data (e.g., thresholds) to be processed by the processors 140, 144. For example, the memory devices 138, 142 may include random access memory (RAM), read only memory (ROM), rewritable non-volatile memory such as flash memory, hard drives, optical discs, and/or the like. Additionally, the processors 140, 144 may include one or more general purpose microprocessors, one or more application specific processors (ASICs), one or more field programmable logic arrays (FPGAs), or any combination thereof. Further, the memory devices 138, 142 may store instructions executable by the processors 140, 144 to perform the methods and control actions described herein for the maze attraction system 10.

It should be appreciated that the maze attraction system 10 may include an augmented reality (AR) game environment that may be visualized and interacted with by the one or more riders. Some or all of the one or more riders may wear a visualization device (e.g., AR goggles or glasses) that may enable the one or more riders to visualize the AR game environment during operation of the maze attraction system 10. For example, the AR game environment may include AR images (e.g., targets 22), and the one or more riders may use the input device 132 to launch AR shells at the AR images. In an embodiment, the elements of the game environment may include projection elements or virtual reality (VR) elements alone, or in combination with AR elements.

Furthermore, the maze attraction system 10 may receive (e.g., at the attraction controller 134) other data about the one or more riders, such as other attractions visited by the one or more riders, points collected by the one or more riders in other sections of the amusement park or theme park, and/or prior experiences (e.g., paths, scores) of the one or more riders in the maze attraction system 10, for example. The data may be provided via a network between the various attractions in the amusement park or theme park and/or the data may be accessed from a database that collects and stores data from the various attractions in the amusement park or theme park. In an embodiment, the one or more riders may register at the beginning and/or end of each ride in the maze attraction system 10 and/or at each attraction in the amusement park or theme park (e.g., via a radio-frequency identification tag, which may be worn on a band or otherwise carried by the one or more riders) to facilitate collection and use of the data to enhance the maze attraction system 10. For example, the attraction controller 134 may utilize the data to adjust the path of the ride vehicle 18 through the maze attraction system 10, the game level, and/or the ride effects (e.g., to provide an enhanced experience for riders having accumulated points in other sections of the park and/or to avoid repeating a prior path through the maze attraction system 10).

Figure 5:
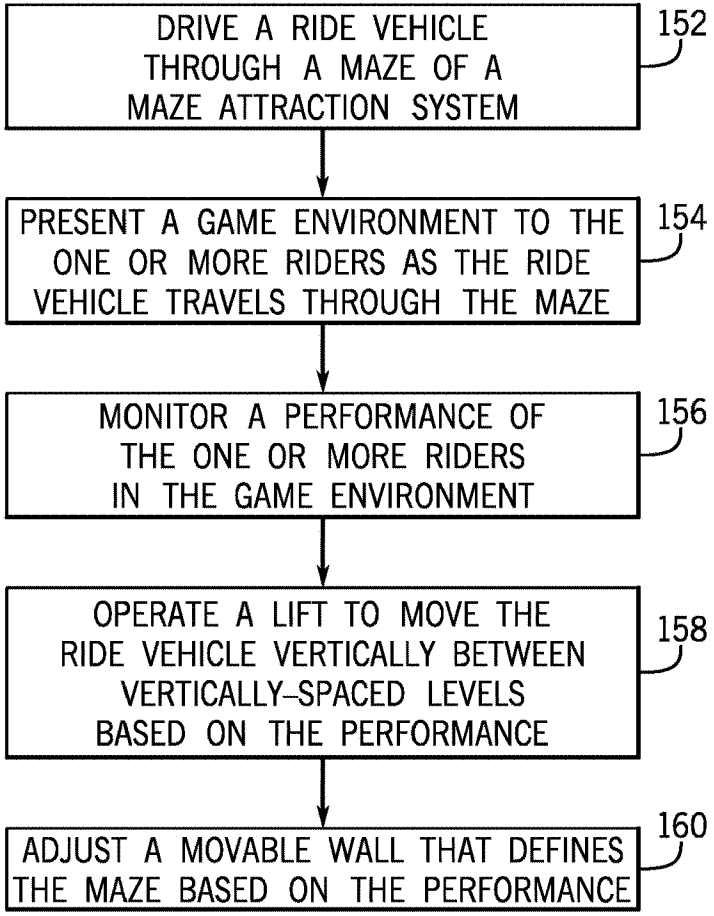
FIG. 5 is a flow diagram of a method of operating the maze attraction system of FIG. 3, in accordance with an embodiment of the present disclosure.

FIG. 5 is a flow diagram of an embodiment of a method 150 of operating the maze attraction system 10. The method 150 disclosed herein includes various steps represented by blocks. It should be noted that at least some steps of the method 150 may be performed as an automated procedure by a system, such as the maze attraction system 10. Although the flow chart illustrates the steps in a certain sequence, it should be understood that the steps may be performed in any suitable order and certain steps may be carried out simultaneously, where appropriate. Additionally, steps may be added to or omitted from the method 150. Further, certain steps or portions of the method 150 may be performed by separate devices. For example, a first portion of a method 150 may be performed by the processor 140 of the attraction controller 134, while a second portion of the method 150 may be performed by the processor 144 of the ride vehicle controller 136.

In step 152, the method 150 may begin by driving the ride vehicle 18 through the maze 12. As discussed above, the ride vehicle 18 may be an automated vehicle that navigates through the maze 12 without direct control by the one or more riders. In step 154, a game environment may be presented to the one or more riders in the ride vehicle 18 as the ride vehicle 18 travels along a path (e.g., the path 20 or the path 52) through the maze 12. The game environment may include one or more targets 22 and/or one or more challenges (e.g., gaming battles and/or puzzles) within the maze 12. In step 156, a performance (e.g., a score and/or an outcome of the one or more challenges) of the one or more riders may be monitored. In step 158, the one or more lifts 30 may be operated to move the ride vehicle 18 vertically between vertically-spaced levels based at least in part on the performance of the one or more riders in the game environment. In step 160, one or more movable walls 50 may be adjusted based at least in part on the performance of the one or more riders in the game environment. By operating the one or more lifts 30 and/or the movable walls 50 based on the game performance, the maze attraction system 10 may provide an interactive ride and a variable experience during repeat rides.

While only certain features of present embodiments have been illustrated and described herein, many modifications and changes will occur to those skilled in the art. It is, therefore, to be understood that the appended claims are intended to cover all such modifications and changes that fall within the true spirit of the disclosure. Further, it should be understood that certain elements of the disclosed embodiments may be combined or exchanged with one another.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An attraction system, comprising:

a first level;

a second level positioned vertically above or below the first level;

a lift configured to move a ride vehicle vertically from the first level to the second level; and one or more controllers configured to:

present a game environment to one or more riders in the ride vehicle as the ride vehicle travels along a path on the first level;

monitor a performance of the one or more riders in the game environment; and control movement of the lift to move the ride vehicle vertically from the first level to the second level based at least in part on the performance of the one or more riders in the game environment.

2. The attraction system of claim 1, wherein the one or more controllers are configured to control the ride vehicle to position the ride vehicle on a platform of the lift and to adjust an adjustable arm of the lift when the ride vehicle is positioned on the platform to move the ride vehicle vertically from the first level to the second level.

3. The attraction system of claim 1, wherein the first level comprises a maze defined by multiple walls, and the ride vehicle travels along the path through the maze on the first level.

4. The attraction system of claim 3, wherein the plurality of walls comprises one or more movable walls, and the one or more controllers are configured to adjust a position of at least one of the one or more movable walls based at least in part on the performance of the one or more riders in the game environment.

5. The attraction system of claim 4, wherein the one or more controllers are configured to monitor a number of points accumulated by the one or more riders in the game environment, and to adjust the position of the at least one of the one or more movable walls in response to the number of points exceeding a threshold.

6. The attraction system of claim 1, wherein the one or more controllers are configured to monitor a number of points accumulated by the one or more riders in the game environment, and the one or more controllers are configured to operate the lift to move the ride vehicle vertically from the first level to the second level in response to the number of points falling below a threshold.

7. The attraction system of claim 1, wherein the one or more controllers are configured to present a challenge to the one or more riders as part of the game environment, and the one or more controllers are configured to operate the lift to move the ride vehicle vertically from the first level to the second level in response to the one or more riders succeeding in the challenge.

8. The attraction system of claim 1, wherein the one or more controllers are configured to present a challenge to the one or more riders as part of the game environment, and the one or more controllers are configured to operate the lift to move the ride vehicle vertically from the first level to the second level in response to the one or more riders failing in the challenge.

9. The attraction system of claim 8, wherein the second level is devoid of the game environment and comprises an exit of the attraction system.

10. The attraction system of claim 1, comprising the ride vehicle and one or more input devices coupled to the ride vehicle, wherein the one or more input devices enable the one or more riders to interact with one or more features in the game environment to accumulate points as the ride vehicle travels along the path.

11. A maze attraction system, comprising:

a maze defined by a plurality of walls; and one or more controllers configured to present a game environment to one or more riders in a ride vehicle as the ride vehicle travels through the maze;

wherein the plurality of walls comprises a first movable wall positioned along a first path and a second movable wall positioned along a second path, the first movable wall and the second movable wall are each configured to move between a respective first position to block passage of the ride vehicle and a respective second position to enable passage of the ride vehicle, the one or more controllers are configured to select and to move one of the first movable wall or the second movable wall from the respective first position to the respective second position to enable passage of the ride vehicle along the first path or the second path, respectively, based at least in part on a performance of the one or more riders in the game environment, and the performance is based at least in part on a number of points accumulated by the one or more riders in the game environment.

12. The maze attraction system of claim 11, wherein the one or more controllers are configured to move the first movable wall in response to the number of points exceeding a threshold and to move the second movable wall in response to the number of points falling below the threshold.

13. The maze attraction system of claim 11, comprising a first level, a second level, and a lift configured to move the ride vehicle vertically from the first level to the second level, wherein the one or more controllers are configured to control operation of the lift based at least in part on the performance of the one or more riders in the game environment.

14. The maze attraction system of claim 13, wherein the first level comprises the maze, the second level is vertically spaced from the first level, the one or more controllers are configured to present a challenge to the one or more riders as part of the game environment, and the one or more controllers are configured to operate the lift to move the ride vehicle vertically from the first level to the second level in response to the one or more riders failing in the challenge.

15. The maze attraction system of claim 14, wherein the second level is devoid of the game environment and comprises an exit of the maze attraction system.

16. A method, comprising:

driving, using one or more controllers, a ride vehicle through a maze;

presenting, using the one or more controllers, a game environment to one or more riders in the ride vehicle as the ride vehicle travels along a path through the maze;

monitoring, via the one or more controllers, a performance of the one or more riders in the game environment; and operating, via the one or more controllers, a lift to move the ride vehicle vertically from a first level to a second level located vertically above or below the first level based at least in part on the performance of the one or more riders in the game environment.

17. The method of claim 16, wherein the maze is defined by a plurality of walls comprising at least one movable wall, and the method comprises adjusting a position of the at least one movable wall based at least in part on the performance of the one or more riders in the game environment using the one or more controllers.

18. The method of claim 16, comprising:

presenting, using the one or more controllers, a challenge to the one or more riders as part of the game environment; and operating, using the one or more controllers, the lift to move the ride vehicle vertically from the first level to the second level in response to the one or more riders failing in the challenge.

19. The method of claim 18, wherein the second level is devoid of the game environment.

20. The method of claim 16, wherein monitoring the performance comprises receiving signals indicative of an interaction between one or more input devices on the ride vehicle and one or more targets in the game environment at the one or more controllers and calculating a point total based at least in part on the signals using the one or more controllers, and operating the lift comprises operating the lift to move the ride vehicle vertically from the first level to the second level based at least in part on the point total.

* * * * *